United States Patent [19]

Haglund

[11] Patent Number: 4,696,650

[45] Date of Patent: Sep. 29, 1987

[54] ARRANGEMENT FOR FITTING A PROPELLER ASSEMBLY TO AN OPENING IN A BOTTOM STRUCTURE OF A WATERCRAFT AND FOR DISMANTLING THE ASSEMBLY THEREFROM

[75] Inventor: Kjell Haglund, Karlstad, Sweden

[73] Assignee: Kamewa AB, Kristinehamn, Sweden

[21] Appl. No.: 736,532

[22] Filed: May 21, 1985

[30] Foreign Application Priority Data

May 23, 1984 [SE] Sweden ..... 8402793

[51] Int. Cl.[4] ..... B63H 1/14

[52] U.S. Cl. ..... 440/49; 440/53; 440/112

[58] Field of Search ..... 440/49, 53, 54, 79, 440/112; 114/264, 265, 244, 293, 210, 179–181; 254/372

[56] References Cited

U.S. PATENT DOCUMENTS

| | | | |
|---|---|---|---|
| 1,912,366 | 6/1933 | Hausenfluck | 114/210 |
| 2,652,018 | 9/1953 | Griffith | 114/180 |
| 4,036,163 | 7/1977 | Pehrsson | 440/112 |

FOREIGN PATENT DOCUMENTS

| | | | |
|---|---|---|---|
| 84/03478 | 9/1984 | World Int. Prop. O. . | |
| 179791 | 6/1962 | Sweden | 254/372 |
| 8201415 | 3/1982 | Sweden . | |
| 471238 | 12/1972 | U.S.S.R. | 114/180 |

*Primary Examiner*—Sherman D. Basinger
*Attorney, Agent, or Firm*—Browdy and Neimark

[57] ABSTRACT

A propeller assembly (2), a so-called thruster, intended to be fitted to an opening (7) in a bottom part (1) of the shell structure of a watercraft, for example an offshore-platform, is provided with a mounting flange (9) which can be connected in a pressure tight fashion to the shell structure around the opening (7). To enable the assembly to be fitted and dismantled from outside the shell structure and beneath the surface of the water on which the craft floats without requiring the assistance of a diver there are used a plurality of lines (12) which can be connected to lifting devices in the watercraft and passed out through a corresponding number of line openings (13) located in the shell structure on one side of the assembly mounting opening (7), so that the ends of the lines can be connected to the line attachments (16; 37) on the assembly (2). These line attachments (16; 37) are so arranged on the mounting flange (9) of the assembly (2) that when the assembly is mounted and the mounting flange (9) connected to the shell structure (1) they are located in the line openings (13) and are accessible from inside the shell structure (1), thereby enabling the lines (12) and the line attachments (16; 37) to be mutually connected from inside the watercraft. The line attachments (16; 37) are provided with seal apparatus (18; 38) which, when the propeller assembly is mounted in position, close the line openings (13), while on the inside of the shell structure (1) adjacent each line opening (13) there is provided a sealing chamber (14,20; 47*a*, 47*b*) which surrounds the line opening and which is provided with a sealing lead-through for the line (12).

11 Claims, 7 Drawing Figures

1
2
3
4
5
6
7
8
9
10
11
12
13
14
15
16
17
18
19
20
20a
21
22
23
26
27
29
31
32
33
34

1
2
3
4
5
6
7
8
9
10
11
12
13
14
16
17
18
19
20
22
23
26
27
29
31
32
33
34
35
36

ARRANGEMENT FOR FITTING A PROPELLER ASSEMBLY TO AN OPENING IN A BOTTOM STRUCTURE OF A WATERCRAFT AND FOR DISMANTLING THE ASSEMBLY THEREFROM

FIELD OF THE INVENTION

The present invention relates to an arrangement for fitting a propeller assembly to an opening located in a bottom part of the shell structure of a watercraft and for dismantling the assembly from said opening, with said opening located beneath the surface of the water on which the watercraft floats.

BACKGROUND OF THE INVENTION

The arrangement according to the invention has been primarily developed for fitting and dismantling propeller assemblies of the kind generally referred to as thrusters. This type of propeller assembly normally comprises, in principle, a propeller mounted on a propeller shaft journalled in a gear housing which accommodates a bevel gear mechanism through which the propeller shaft is coupled to a drive shaft which extends through a tubular support strut, one end of which is connected to the gear housing to support the same. The other end of the strut is intended for installation in an opening located in a bottom part of the shell structure or the hull of the watercraft, to enable the drive shaft to be connected to propeller-drive machinery located within the hull. To facilitate mounting of the propeller assembly around the opening in the bottom of the watercraft, the strut has located at the upper end thereof, or in the vicinity of said upper end, a mounting flange which can be bolted firmly to a mounting ring encircling the opening in said shell structure. The strut is often journalled in the mounting flange in a manner which permits the whole of the assembly comprised of the strut, gear housing and propeller to be swung about an axis which coincides with the axis of the drive shaft, and the strut can be coupled to machinery arranged within the hull and adapted to carry out this rotary motion. This enables the propeller force generated by the propeller assembly to be set to any desired direction. Such a propeller assembly is usually called a rotatable thruster.

Propeller assemblies of the aforedescribed kind are being increasingly used for moving and maneuvering, e.g. holding position, of different types of platforms used in the offshore industry. Such propeller assemblies, however, are also used in various types of special-duty watercraft, such as craft equipped for sea-diving purposes, crane-bearing watercraft, cable-laying vessels, and can also be used for moving and maneuvering, for example, floating docks, pontoons and the like. Accordingly, the term "watercraft" used in the aforegoing and in the following text is meant to include all water-buoyant constructions and devices which float in water and which can be moved therein and with which a propeller assembly of the aforementioned kind can be used.

It must be possible to fit and dismantle such propeller assemblies, for servicing, repair and exchange purposes, without needing to take the watercraft concerning into dock. Consequently, it must be possible to fit and to dismantle the propeller assembly with the mounting opening in the bottom of the watercraft beneath the surface of the water. Devices have been proposed and designed with which fitting and dismantling of the propeller assembly can be effected from within the confines of the watercraft, but because of the large dimensions of the propeller assembly and its weight, these devices are highly space consuming, expensive and impracticable. Consequently, it is endeavored to fit and dismantle such propeller assemblies externally of the watercraft in question, i.e. it shall be possible to disconnect the assembly from the drive and rotary machinery from within the watercraft, and to remove the assembly from its mounting around the aforesaid opening and then lift the assembly on the outside of the hull of the vessel, up to the surface of the water. Similarly, it shall also be possible to move the assembly from the water surface externally of the shell structure of the watercraft down to the intended mounting opening in the bottom of the watercraft and there secured to the shell and connected to the drive and rotary machinery within said craft. It is known to use for this purpose and plurality of lines connected to powerful lifting devices located on the watercraft or optionally on an auxiliary craft, and passed through tubes which extend through the interior of the watercraft and out through the shell structure thereof, by the side of the propeller assembly mounting opening. The ends of these lines are connected to the part of the propeller assembly located in the water beneath the shell structure, and subsequent to disconnecting the assembly from the drive and rotary machinery within the watercraft and from the shell structure, the assembly can be lowered by means of the lines and the aforesaid lifting devices, down out of the mounting opening through a distance sufficient to enable the assembly to be lifted clear of the hull of the watercraft to the surface of the water on one side of said hull, with the aid of one or more further lines connected to lifting devices on the watercraft or on an auxiliary vessel. The propeller assembly is fitted to the mounting opening in the reverse order, by first lowering the propeller assembly with the aid of one or more lines externally of the hull of the craft to a position at which the lines extending through the tubes located on the side of the mounting opening can be secured to the propeller assembly and used to lift the assembly and position the same in the mounting opening in the shell of the watercraft. These known arrangements for fitting and dismantling the propeller assembly externally of the craft beneath water level require the use of divers, however, for connecting and disconnecting the lines to and from the assembly. Offshore platforms, however, are often situated in sea areas in which prevailing or expected weather conditions over a large part of the year render diving unsafe. This presents a serious problem, since the periods in which weather conditions are extremely bad or threaten to be so can be extremely prolonged.

OBJECTS OF THE INVENTION

Consequently, the object of the present invention is to provide an arrangement with which a propeller assembly can be fitted to an opening located in a bottom part of the shell structure of a watercraft from outside the craft and dismantled from said opening from a location external of said shell structure, without requiring the assistance of divers.

This object is achieved in accordance with the invention with an arrangement constructed in the manner set forth in the following claims.

BRIEF DESCRIPTION OF THE DRAWINGS

The invention will now be described in more detail with reference to separate embodiments thereof illustrated in the accompanying drawings, in which.

DETAILED DESCRIPTION OF THE INVENTION

Figures 1, 2:
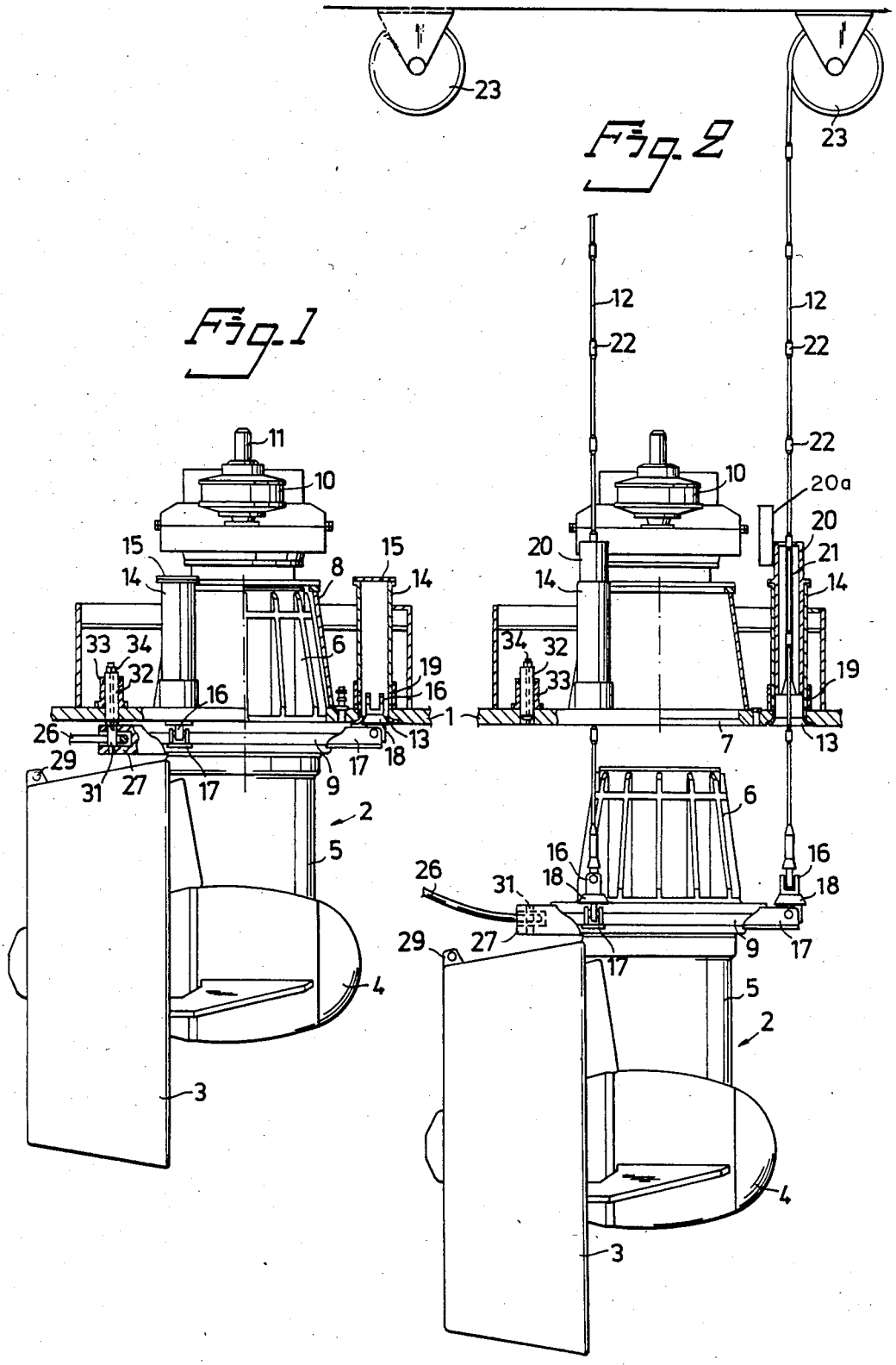
FIGS. 1 and 2 illustrate schematically in side view and partially in vertical section a first embodiment of an arrangement according to the invention, FIG. 1 showing the propeller assembly mounted to the shell structure of a watercraft, and FIG. 2 showing the assembly detached therefrom and lowered somewhat.

FIGS. 1 and 2 illustrate schematically part of the shell structure 1 of a watercraft, for example a pontoon forming part of an offshore platform. As shown in FIG. 1, there is mounted to the shell structure 1 a propeller assembly, a so-called rotatable thruster. This propeller assembly, which is generally referenced 2, comprises in a conventional manner a propeller, not visible in the drawing, which is surrounded by a stationary propeller shroud 3 and mounted on a horizontal propeller shaft journalled in a gear housing 4. This gear housing accommodates a bevel gearing through which the propeller shaft is coupled to a vertical drive shaft which extends upwardly through a tubular strut 5, the lower end of which is connected to the gear housing in a manner to support the same. The upper end of the strut is journalled in an upper part 6 of the propeller assembly, such that the assembly formed by the strut 5, the gear housing 4, the propeller shroud 3, and the propeller can be rotated about a vertical rotational axis coinciding with the drive axis. The propeller assembly is mounted in an opening 7 in the shell structure 1 (cf. FIG. 2) with the upper part 6 of the assembly located inwardly of a watertight well or recess 8 located on the inside of the shell structure 1. The propeller assembly 2 is held in this position by means of a mounting flange 9 arranged at the lower end of the part 6, said flange being secured sealingly to the outer face of a mounting ring incorporated in the shell structure 1 and encircling the opening 7, by means of bolts not shown. The support strut 5 rotatably journalled in the part 6 is connected in a manner not shown to a schematically illustrated rotary machine 10, arranged within the watercraft for rotating the strut 5 and therewith also the gear housing 4 and the propeller, about the vertical rotational axis. The vertical drive shaft extending up through the strut is coupled, in a manner not shown, to an upper drive shaft 11, which is connected to the propeller drive machinery, not shown, installed within the watercraft. The propeller assembly and the various elements for attaching the same to the shell structure 1 and for coupling the assembly to the rotary machinery and the drive machinery may be designed in the manner described in Swedish Patent Application No. 8201415-0 for example. As will be understood from this publication, this design enables all working operations needed to bolt the mounting flange 9 to the shell structure 1 and for coupling the strut 5 to the rotary machinery 10 and the drive shaft to the drive machinery, to be accomplished from within the watercraft. The propeller assembly, the means for attaching the same to the shell structure 1, and for coupling the same to the aforesaid machines may also be constructed and designed in many different ways, however.

Subsequent to loosening the mounting flange 9 from the shell structure 1 and disconnecting the assembly 2 from the drive and the rotational machines, it shall be possible to lower the assembly down from the mounting well 8 and out of the opening 7, and to move the assembly through the water externally of the shell structure of said craft, up to the surface of the water. It shall also be possible to move the propeller assembly in the reverse direction, for the purpose of fitting the same to the shell of said craft. It must be possible to fit and to remove the assembly without the use of divers.

To this end there is used in accordance with the invention a plurality of fitting and dismantling lines 12 (cf FIG. 2). There are used three such lines 12 in the illustrated embodiment. The shell structure 1 has provided therein for each of the lines 12 an opening 13 through which a respective line can be passed out therethrough. Located on the inner surface of the shell structure 1 in the vicinity of each opening 13 is a cylindrical sealing chamber 14, the lower end of which is connected in a pressure-tight fashion to the inner surface of the shell structure 1 around the line opening 13, and the upper end of which can be closed with a cap 15, as illustrated in FIG. 1. The propeller assembly has mounted thereon for each of the three lines 12 a line attachment 16 which is so arranged on the mounting flange 9 that when the propeller assembly is mounted in position, as shown in FIG. 1, the attachments protrude into respective line openings 13, to be located on the inner side of the shell structure and within the sealing chambers 14. In the illustrated embodiment, the line attachments 16 are mounted on bracket arms 17 extending radially outwards from the mounting flange 9. The line attachments 16 are also provided with sealing means 18 which in the mounted position of the propeller assembly close and seal the line openings 13 in the shell structure 1, in the manner illustrated in FIG. 1.

When dismantling the propeller assembly from the shell structure, the cap 15 is first removed from the respective upper ends of the cylinders 14. The bottom ends of the lines 12 are then passed down through the cylinders 14 and are secured to the line attachments 16 through closable openings 19 in the walls of the cylinders 14. Tubular sealing sleeves 20 have previously been placed on the lines 12 and are moved down into the cylinders 14 and fastened therein. The sealing sleeves 20 seal the cylinders 14 and are provided with a lead-through for the lines 12. In the illustrated embodiment, this lead-through has the form of a channel or passage 21 in the sealing sleeve 20, the diameter of said passage being slightly greater than the diameter of the respective line 12. In turn the line 12 has placed thereon, in uniform spaced relationship therealong, a plurality of sealing sleeves 22 which have the same diameter as the passage 21 and which seal therein. The spacing between the sealing sleeves 22 on the line 12 is shorter than the length of the passage 21, so that there is no direct communication between the interior of the watercraft and the outer surroundings when the line 12 is fed out through the passage 21 in the tubular sleeve 20 and the line opening 13 in the shell structure 1. The lines 12 are connected to a suitable lifting device located on the watercraft, this device being schematically indicated at 23 and having the form, for example, of a winch or the like, or a construction jack having reciprocatingly movable gripping devices which grip the line 12 and move the same stepwise. These reciprocatingly movably gripping devices can then use the sealing sleeves 22 located on the line 12 as engagement points, so as not to wear or damage the line itself.

When these steps have been completed, the whole of the propeller assembly 2 can be lowered down, out of the mounting opening 7 and the mounting well 8 with the aid of the lines 12. FIG. 2 illustrates the propeller assembly 2 in a slightly lowered position, beneath the shell structure 1. As the propeller assembly is lowered pressurized air is suitably introduced into the interiors of the cylinders 14 by appropriate means 20*a* therefor as indicated in the FIG. 2 adjacent cylinder 14 so that no water is able to enter said cylinders.

Figure 5:
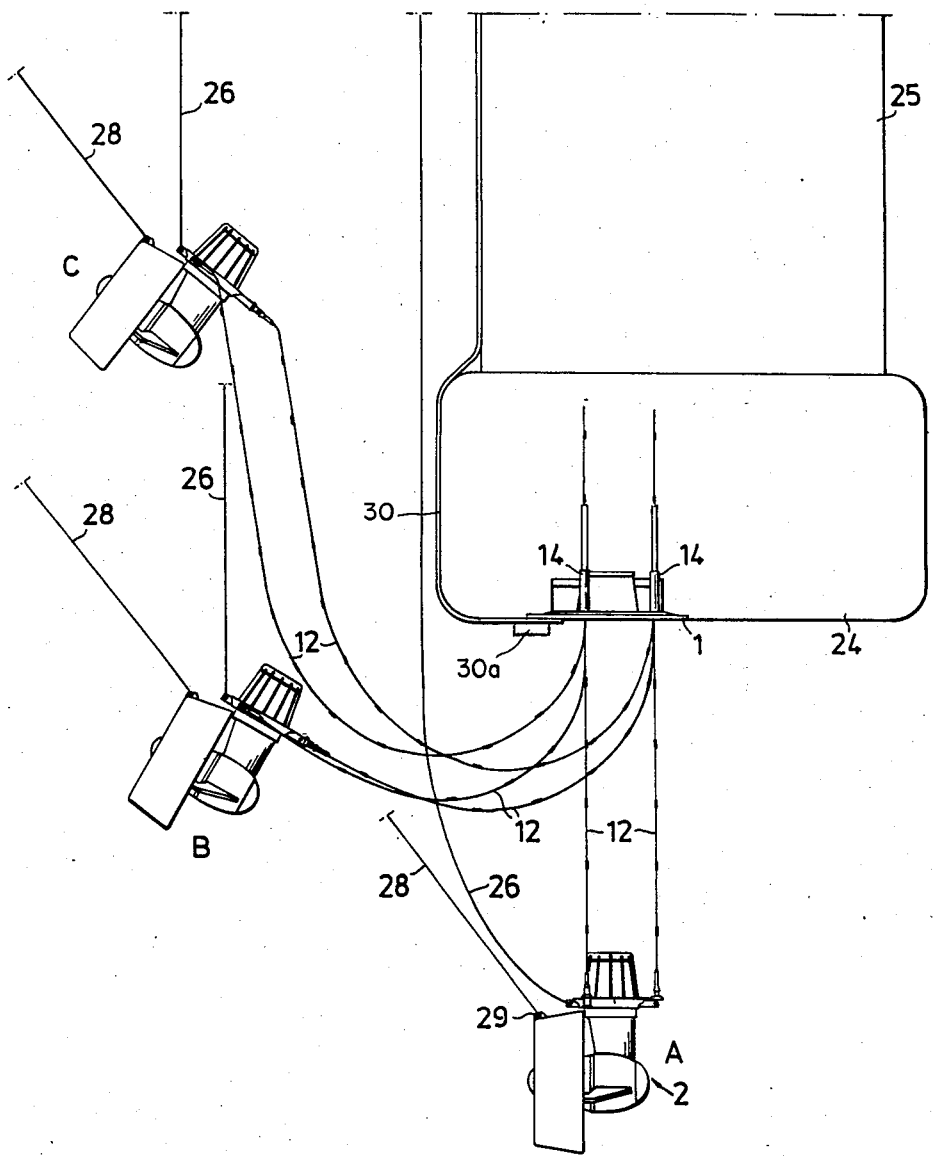
FIG. 5 illustrates schematically movement of a propeller assembly between the surface of the water and a position immediately beneath the propeller-assembly mountingopening in the watercraft.

Subsequent to being lowered to a position sufficiently far beneath the shell structure 1, for example to the position marked A in FIG. 5, the propeller assembly shall be lifted up through the water to the surface thereof, externally of the watercraft, which watercraft is schematically shown in FIG. 5 as an off-shore platform, of which only a pontoon 24 and a part of an associated support leg 25 is illustrated. The assembly is lifted with the aid of a lifting line 26, the bottom end of which is secured to a line attachment 27 located on the mounting flange 9 of the propeller assembly 2 and the other thereof is secured to a suitable lifting device, not shown, which is either located on the actual watercraft or on an auxiliary vessel. FIG. 5 illustrates various positions B and C occupied by the assembly 2 during the aforesaid lifting operation.

The fitting and dismantling lines 12 thus accompany the propeller assembly 2 throughout the whole of its passage to the surface. Subsequent to lifting the assembly up onto the deck of the watercraft or an auxiliary craft, the lines 12 and the line 26 can be disconnected from the propeller assembly and optionally connected to a further assembly, which is then lowered down into the water and brought into position in the mounting opening 7 and the mounting well 8 in the aforedescribed manner with the aid of the lifting line 26 and the assembly fitting and dismantling lines 12. If no propeller assembly is to be fitted immediately, the lifting line 26 and fitting and dismantling lines can instead be used to fit a cover plate around the opening 7 in the shell structure 1, this cover plate also being provided with similar line attachments for the lines 12, so that the line opening 13 in the shell structure can also be closed.

In FIG. 5 there is shown a further line 28 which is connected to a line attachment 29 on the propeller shroud 3 of the assembly. This line is a steadying line intended to prevent the assembly 2 from twisting and subsequent wrapping of the fitting and attachment lines around one another. This need only be prevented when fitting the propeller assembly, i.e. when lowering the same from the surface of the water, into position in the mounting opening 7 in the shell structure 1. The steadying lline 28 can thus be attached to the line attachment 29 on the propeller assembly 2 above the surface of the water, for example with the aid of a coupling means which can be released by remote-control, or by passing the line freely through the line attachment or lug 29, so that the steadying line 28 can be released from the propeller assembly in the position marked A in FIG. 5, without needing to use a diver therefor. Normally, it is not necessary to use a steadying line when lifting the assembly to the surface, since it is of less importance whether the lines wrap around one another or not.

In certain types of watercraft, the lifting line 26 located externally of the shell structure thereof can be left permanently attached to the assembly 2, with no disadvantage. If such is not the case, the lifting line 26 can be brought into position by means of a self-propelling carriage 30*a* capable of moving along a track 30 (cf FIG. 5) located on the outer surface of the shell structure 1. This carriage is adapted to convey the end of the lifting line 26 from the surface of the water to the mounted propeller assembly 2 (as illustrated in FIG. 1), wherein an eye attached to the end of the line 26 is passed into the fork-shaped line attachment 27. The line attachment 27 is positioned on the propeller assembly mounting flange 9 so as to lie immediately beneath the shell structure 1. Located in the shell structure 1 is a tool which can be manipulated from inside the shell structure and by means of which a locking bolt 31 can be fitted to the line attachment 27, subsequent to fitting the eye thereto. In the illustrated embodiment this tool has the form of a screw rod 32, which is sealingly arranged in an opening in the shell structure 1, and a sealing sleeve 33 located on the inside of said shell structure. This screw rod 32 can be connected to the locking bolt 31 of the line attachment 27 with the aid of a screw 34 extending through the screw rod 32. Thus, the locking bolt 31 can be placed in position on and removed from the line attachment 27 with the aid of the screw rod 32, to enable the line 26 to be connected to and disconnected from the propeller assembly 2. No diver is therefore required to carry out this task.

Figures 3, 4:
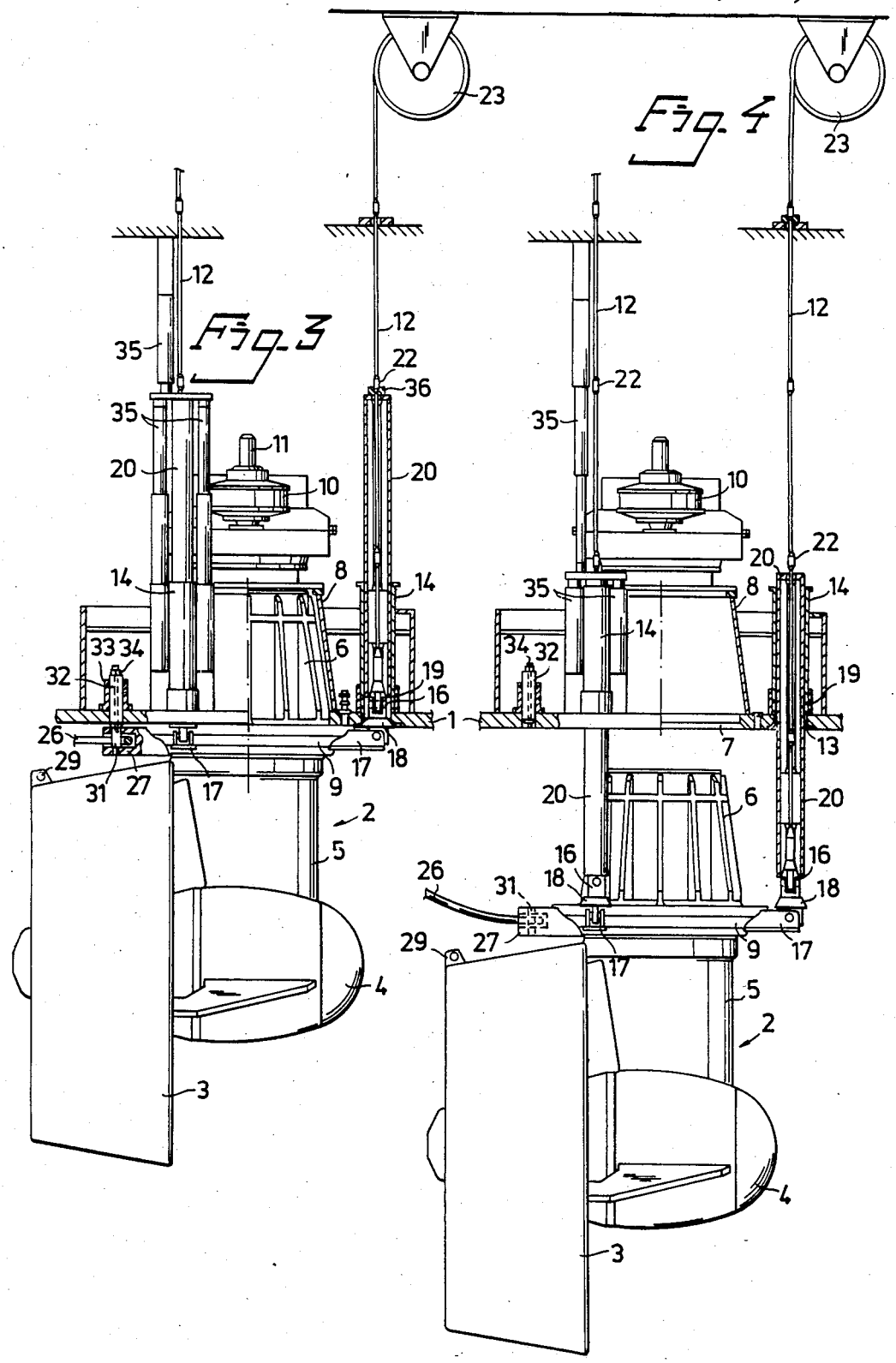
FIGS. 3 and 4 are side views similar to the side views of FIGS. 1 and 2 but illustrating another embodiment.

The only difference between the arrangements according to the invention illustrated in FIGS. 3 and 4 and the aforedescribed embodiments mainly resides in the fact that the tubular sleeves 20 mounted in the cylinders 14 and sealingly embracing the lines 12 are substantially longer and are also axially displaceable in said cylinders. These longer, axially displaceable tubular sleeves 20 can be pushed out of and drawn in through the line openings 13 in the shell structure 1 by means of an array of hydraulic piston-cylinder devices 35 arranged on the inside of the shell structure 1. This enables the tubular sleeves 20 to be used as rigid guide rods which guide and stabilize the propeller assembly 2 during its movement close into the shell structure 1. This is illustrated in FIG. 4. In this way there is eliminated substantially all risk of the propeller assembly being caused to swing when fitting or dismantling the same, so as to strike the shell structure or the edge of the mounting opening 7 and cause damage to either the propeller assembly and/or the shell structure and the opening 7. In addition, the propeller assembly can be aligned more positively and reliably with the mounting opening 7 when fitting the assembly to the opening.

The piston-cylinder devices 35 connected to the tubular sleeves 20 can also be used to displace the propeller assembly 2 during its movement close into the shell structure 1, by placing couterpressure devices 36 temporarily between suitable sealing sleeves 22 on the lines 12 and the piston-cylinder devices 35.

It will be understood that other means than the illustrated cylinders 14 can be used to guide the tubular sleeves 20 serving as guide rods.

Figure 6:
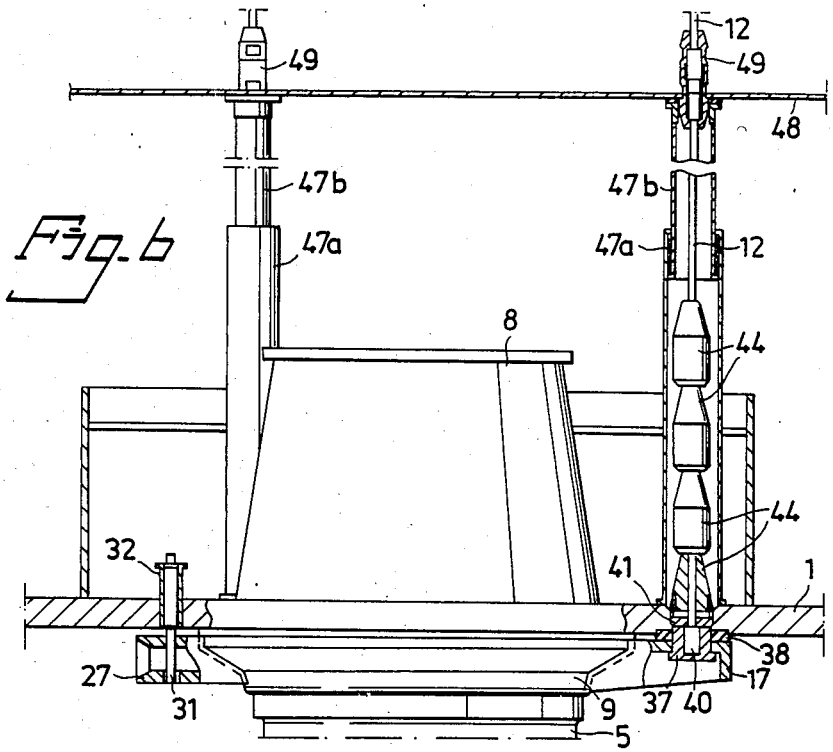
FIG. 6 is a partial side view partly in section, of a third embodiment of the invention.
Figure 7:
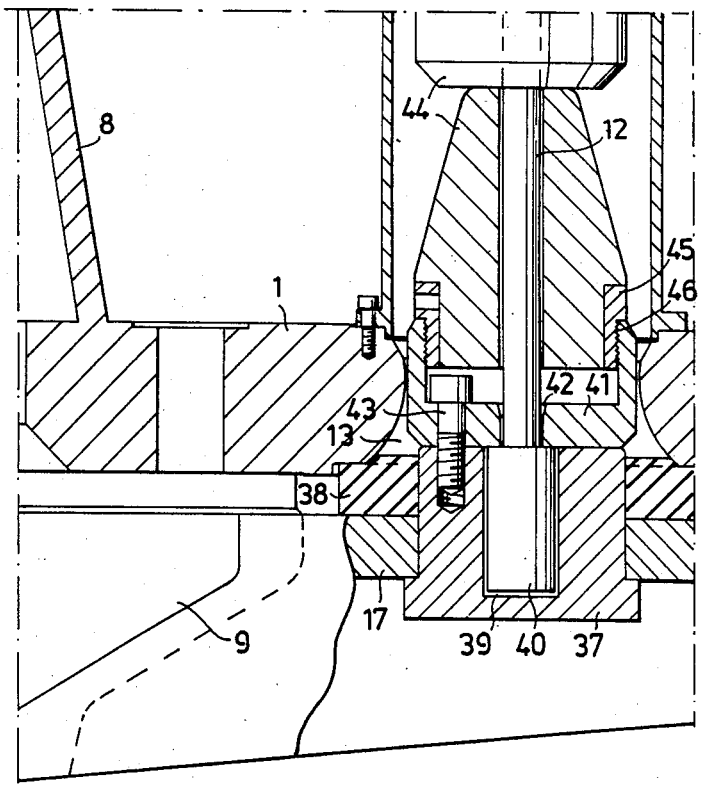
FIG. 7 is a vertical sectional view, in larger scale, of a detail of the embodiment illustrated in FIG. 6.

The main difference between the embodiments illustrated in FIGS. 6 and 7 and those described above resides primarily in the configuration of the line attachments for the fitting and dismantling lines 12, and hence solely these devices are illuminated in detail in FIG. 6.

As will be seen more clearly from FIG. 7, in this embodiment of the invention each of the line attachments located on bracket arms 17 projecting radially from the mounting flange 9 of the propeller assembly comprises a connecting sleeve 37 which is firmly mounted to the bracket arm 17 centrally of the respective line opening 13 in the shell structure 1. Arranged around the connecting sleeve 37 is a sealing ring 38 which seals around the line opening 13 when the propeller assembly is mounted in the position shown in FIGS. 6 and 7. The connecting sleeve 37 has provided therein a bore 39 which accommodates a line head 40 attached to the lower end of the fitting and dismantling line 12. The line head 40, and therewith the line 12, is held firmly in the connecting sleeve 37 by means of a cup-shaped locking element 41, which has a through-passing opening 42 provided therein for the line 12 and which is connected to the connecting sleeve 37 by means of a number of bolts 43. Arranged around the lower end of the line 12 is a number of cylindrical and partially conical bodies 44. The lower cylindrical part of the lowermost of the bodies 44 is provided with an externally screw-threaded ring 45, by means of which said lowermost body 44 can be screwed into a corresponding internal screw thread 46 provided on the cup-shaped locking element 41. As will be seen more clearly from FIG. 6, the line 12 is embraced within the watercraft by a tube comprising two sections **47*a* and 47*b* which can be moved telescopically in relation to one another, this tube forming a liquid-tight passage for the line 12 between the shell structure 1 of the watercraft and an upperdeck 48 thereof, for example the upper side of a pontoon of an offshore platform. The lower end of the lower tube part 47*a* is mounted in a liquid-tight fashion to the inside of the shell structure 1, while the upper end of the upper tube part 47*b* is attached in a liquid-tight fashion to the deck 48. Also provided here is a liquid-tight lead-through 49 for the line 12**.

Assuming that the propeller assembly has been mounted in position, with the mounting flange 9 attached to the shell structure 1 in the aforedescribed manner, and the lines 12 are to be released from the propeller assembly, the following sequence is undertaken for each line 12. The lower tube part **47*a* is first released from the shell structure 1 and moved axially outwardly along the upper tube part 47*b*. This affords access to the lower body 44 located around the line 12, so that the body can be unscrewed from the locking element 41. It should be noted that the diameter of the centre bore passing through the body 44 and accommodating the line 12 is such as to enable the body 44 to pass freely along the line 12. Subsequent to unscrewing the lower body 44 from the locking element 41, the bolts 43 can be reached in order to remove the locking element 41 from the connecting sleeve 37. This enables the line head 40 of the line 12 to be withdrawn from the connecting sleeve 37, thus releasing the line from the connecting sleeve 37 and therewith from the propeller assembly. The line head 40 can thereafter be detached from the line 12 and the locking element 41, together with the bodies 44, removed. The lower tube part 47*a* is then moved axially downwards and its lower end attached to the shell structure 1, so as to reestablish a liquid-tight channel for accommodating the line 12. If it is now assumed that the watercraft is momentarily positioned in the surrounding water such that the deck 48 is located above the surface of the water the whole of the line 12 can be withdrawn from the channel formed by the tube parts 47*a*, 47*b*. The sealing lead-through 49 accommodating the line 12 can then be removed and replaced with a cover means adapted to seal the upper end of the line channel. This obviates the risk of water entering the line channel formed by the tube parts 47*a*, 47*b*, even when the watercraft is brough to a position in which the deck 48** is beneath the surface of the water.

Fitting of the line 12 and the connection of the lower end of the line to the connecting sleeve 37 on the propeller assembly are effected in the reverse order.

The purpose of the bodies 44 provided on the lower end of the line 12 is to guide the line 12 in the line opening 13 in the shell structure 1 when the propeller assembly is lowered from the shell structure 1 or lifted into engagement therewith during respective dismantling and fitting operations.

Although the invention has been described with reference to fitting so-called thrusters to the shell structure of a watercraft and dismantling said thrusters therefrom, it will be apparent that the invention can also be applied to fit and dismantle other kinds of propeller assemblies.

It will be understood that modifications and other embodiments are conceivable within the scope of the invention. An essential feature of the invention is primarily that the line attachments intended for the fitting and dismantling lines are arranged on the mounting flange of the propeller assembly in a manner such as to be accessible from within the hull, with the propeller assembly mounted in position, through line openings provided in the shell structure. This enables the lines to be connected and disconnected to and from the line attachments from inside the hull of the watercraft without requiring the use of divers.

I claim:

1. An arrangement for mounting and dismounting a thruster propeller unit in an opening located in a bottom part of a shell structure of a watercraft, externally of said shell structure and beneath the surface of the water in which the craft floats, said thruster propeller unit being provided with a mounting flange which can be fastened in a pressure-tight fashion around said opening in said shell structure, and the arrangement including a plurality of lifting lines operable from lifting devices located in the watercraft and provided with connection means at their ends, for each said lifting line, an associated line opening arranged in said shell structure adjacent said opening so that the associated lifting line can be passed through each said line opening, for each said lifting line, an associated line attachment arranged on said mounting flange of the thruster propeller unit so that, when the propeller unit is mounted in position by being connected to said shell structure via said mounting flange, each said line attachment is located in the associated line opening and is accessible from the inside of the shell structure, wherein said connection means at the end of each said associated lifting line can be connected to and disconnected from said line attachment from inside the shell structure, and each said line attachment is provided with sealing means for sealing the associated line opening when the propeller unit is in its mounted position, said sealing means being located externally of the connection between the line attachment and the connection means on the end of the lifting line.

2. An arrangement as claimed in claim 1, wherein at each line opening on the inside of said shell structure there is arranged a sealing chamber which surrounds said line opening in a water-tight fashion and which is provided with a sealing lead-through for the lifting line.

3. An arrangement as claimed in claim 2, wherein said sealing chamber is provided with a closeable opening through which access can be had to the associated line attachment and the connection means at the end of the associated lifting line.

4. An arrangement as claimed in claim 2, comprising means for supplying air under pressure to the interior of said sealing chamber.

5. An arrangement as claimed in claim 2, wherein said sealing chamber includes a cylinder having one end attached in a water-tight fashion to the inside of said shell structure around the associated line opening and an open opposite end, a removable cap for closing said opposite end of said cylinder in a water-tight fashion, and a tubular sleeve which can be inserted sealingly in said cylinder through said opposite end after removal of said cap and which is provided with said sealing lead-through for the associated lifting line.

6. An arrangement as claimed in claim 2, wherein said sealing line lead-through for the lifting line includes an elongated passage for the lifting line having a slightly larger diametr than the lifting line, and sealing bodies are placed in uniform spaced relationship on the lifting line and have the same diameter as said passage, the distance between adjacent sealing bodies being shorter than the length of said passage.

7. An arrangement as claimed in claim 2, wherein said sealing chamber includes a tubular device comprising two parts which can be moved telescopically in relation to one another, one end of the tubular device being detachably connected in a water-tight fashion to the inside of said shell structure around the associated line opening, and the other end of said tubular device being provided with said sealing lead-through for the associated lifting line.

8. An arrangement as claimed in claim 1, comprising tubular rods enclosing said lifting lines and arranged for axial movement inwardly and outwardly of said line openings for guiding and stabilizing the movement of said propeller unit in the near vicinity of said shell structure when mounting and dismounting the propeller unit, and hydraulic piston-cylinder devices located inwardly of said shell structure for moving said tubular rods axially.

9. An arrangement as claimed in claim 1, wherein said lifting lines are provided with guide bodies located on those parts of the lifting lines nearest said connecting means at the end of the lines and effective to guide the lifting lines through said line openings during mounting or dismounting operation.

10. An arrangement as claimed in claim 1, comprising an additional lifting line located on the outside of said shell structure of said watercraft, an additional line attachment located on said mounting flange of said propeller unit so as to lie close to said shell structure when said propeller unit is in its mounted position, and a tool located opposite said line attachment and extending through the shell structure, which tool can be manipulated from the inside said shell structure for connecting the end of said additional lifting line to said additional lifting line attachment and to disconnect the same therefrom.

11. An arrangement as claimed in claim 10, comprising a track extending along the outer surface of said shell structure between said tool and the surface of the water, and carriage means movable along said track for moving the end of said additional lifting line from the surface of the water down to said additional lifting line attachment when said propeller unit is in its mounted position.

* * * * *